US012722927B2

(12) United States Patent
Gerri

(10) Patent No.: US 12,722,927 B2
(45) Date of Patent: Sep. 1, 2026

(54) FEEDING UNIT FOR FEEDING A PLASTIC FILM

(71) Applicant: PLUSLINE S.R.L., Bologna (IT)

(72) Inventor: Vittorio Gerri, Bologna (IT)

(73) Assignee: PLUSLINE S.R.L., Bologna (IT)

( * ) Notice: Subject to any disclaimer, the term of this patent is extended or adjusted under 35 U.S.C. 154(b) by 509 days.

(21) Appl. No.: 17/611,728

(22) PCT Filed: Apr. 16, 2020

(86) PCT No.: PCT/IT2020/050095

§ 371 (c)(1),
(2) Date: Nov. 16, 2021

(87) PCT Pub. No.: WO2020/245850

PCT Pub. Date: Dec. 10, 2020

(65) Prior Publication Data

US 2022/0219930 A1 Jul. 14, 2022

(30) Foreign Application Priority Data

Jun. 3, 2019 (IT) ..... 102019000007812

(51) Int. Cl.
*B65H 23/188* (2006.01)
*B65B 41/12* (2006.01)
*B65B 41/18* (2006.01)

(52) U.S. Cl.
CPC ..... *B65H 23/1882* (2013.01); *B65B 41/12* (2013.01); *B65B 41/18* (2013.01); *B65H 2801/81* (2013.01)

(58) Field of Classification Search
CPC ..... B65H 23/1882; B65H 2801/81; B65B 41/12; B65B 41/18; B65B 11/22;
(Continued)

(56) References Cited

U.S. PATENT DOCUMENTS 3,678,646 A * 7/1972 Clark ..... B65B 11/04 156/506
4,389,009 A 6/1983 Yamashita
(Continued)

FOREIGN PATENT DOCUMENTS

DE 102011015343 A1 10/2012
EP 1584558 A1 10/2005
(Continued)

OTHER PUBLICATIONS

FR-2614884 A1 translation (Year: 1988).*
(Continued)

*Primary Examiner* — Jonathan G Riley
(74) *Attorney, Agent, or Firm* — Maier & Maier, PLLC

(57) ABSTRACT

Feeding unit for feeding a plastic film in packaging machines, including: a unit for unwinding the film from a reel; a cutting device downstream of the unwinding unit and intended to form sheets of predetermined length; a transfer device downstream of the cutting device; a positioning device downstream of the transfer device and comprising drive belts able to engage the upper and the lower faces of the film. The belts of the positioning device are controlled by a control unit connected with optical elements that detect the passage of signs formed on the film. The control unit is programmed to compare a transit time elapsing during the passage of the signs of a same side of two consecutive sheets with a cycle time and to increase or decrease the speed of said belts if the transit time is less than or greater than the cycle time.

10 Claims, 8 Drawing Sheets

(58) Field of Classification Search
CPC ..... B65B 25/146; B65B 51/14; B65B 59/001; B65B 59/003
See application file for complete search history.

(56) References Cited

U.S. PATENT DOCUMENTS 4,858,416 A * 8/1989 Monaghan ..... B29C 66/836 53/553
5,182,894 A * 2/1993 Bate ..... B65B 61/10 53/399
5,458,062 A * 10/1995 Goldberg ..... B65H 23/046 101/485
5,979,732 A * 11/1999 Crowley ..... G03G 15/6517 226/111
6,056,180 A * 5/2000 Crowley ..... B65H 20/06 226/188
6,067,780 A * 5/2000 Gentili ..... B65B 25/146 53/376.2
7,104,031 B2 * 9/2006 Baggot ..... B65B 63/02 53/550
7,174,237 B2 * 2/2007 Takayama ..... G03G 15/0131 700/230
9,809,401 B2 * 11/2017 Mayer ..... B65G 47/084
2001/0009089 A1 * 7/2001 Todd ..... B29C 65/18 53/64
2006/0130435 A1 * 6/2006 Hada ..... B65B 9/067 53/550
2008/0105578 A1 5/2008 Cerf
2010/0097462 A1 * 4/2010 Carlson ..... G06T 7/70 348/143
2019/0241288 A1 * 8/2019 Knueppel ..... B65B 41/18
2019/0389607 A1 * 12/2019 Kirsch ..... B65B 59/005

FOREIGN PATENT DOCUMENTS

FR 2614884 A1 * 11/1988
GB 2359300 A 8/2001

OTHER PUBLICATIONS

International Search Report and Written Opinion issued on Aug. 17, 2020 in corresponding International Application No. PCT/IT2020/050095; 11 pages.

* cited by examiner

FEEDING UNIT FOR FEEDING A PLASTIC FILM

FIELD

The present invention relates to a feeding unit for feeding a plastic film in packaging machines intended in particular, although not exclusively, for the packaging of paper rolls. EP1584558A1 discloses a unit for feeding and cutting into lengths a strip of wrapping material.

U.S. Pat. No. 6,067,780 discloses an automatic machine for packaging products such as paper rolls, using a packaging sheet which is wrapped and folded around the product and sealed on itself.

BACKGROUND

In the packaging machines of the type mentioned above, the packaging is carried out by sequentially feeding the individual products or groups of products along a forming line on which the products advance passing through a series of operating stations in each of which specific operations are carried out to obtain the desired packaging.

In general, in the various stations of an automatic machine for packaging products such as paper rolls, the following operating steps are carried out: entry into the machine of products covered by a sheet of packaging material, in particular a plastic film; wrapping the packaging sheet around the products and overlapping the opposite edges of this sheet under the products and welding the edges; formation, on said packaging sheet, of the closing flaps of the package; folding and sealing said flaps to seal the package thus obtained.

In practice, the paper rolls are held together by a wrapping consisting of the plastic material film (for example, polypropylene or polyethylene) wrapped around the paper rolls and subsequently folded and sealed to form the final package.

A packaging machine so structured is served by a feeding unit for feeding the plastic film which is generally placed on a side opposite to the inlet for the rolls to be packed.

The film feeding unit comprises unwinding means for unwinding the film from a corresponding reel, a cutting device, a transfer device and a positioning device. The unwinding unit generally comprises a pair of unwinding rollers, between which the film is passed and which are suitably motorized so as to exert a dragging action on the film which determines the unwinding of the film itself from the respective reel. The cutting device is intended to produce a discontinuous incision in the film to create a tear-off line which allows to obtain sheets of a predetermined length from the film. The transfer device is formed by opposing belts, wound in a loop around corresponding guide pulleys, that have always a side oriented along the advancement direction of the film and are mutually arranged so as to engage both sides of the film to guide it between an inlet area, near the cutting device, and an exit area near the positioning device. The latter is arranged downstream of the transfer device and extends up to a station of the packaging machine intermediate between the forming line and a lifting station on which the rolls are positioned in the configuration to be packaged. The positioning device consists of opposed motorized belts, wrapped around corresponding pulleys so as to form two horizontal rings developed according to the direction of exit of the film. These belts have opposite transfer sections and are pressed against each other on both sides of the film by means of pressure rollers, so as to transfer the film sheet horizontally to the elevator of the lifting station.

For a correct execution of the packages it is necessary that the single sheets are positioned on the elevator so that the edges of each sheet are the most possible parallel to the homologous edges of the elevator. However, the accuracy in the positioning of the packaging sheets on the elevator of the packaging machine not always satisfies the current increasingly stringent production needs in relation to the packaging quality. In addition, in traditional machines the belts of the transfer device are operated at a constant speed, which depends on the production speed of the packaging machine, while the belts of the positioning device are operated with an initial speed lower or equal to the previous one to engage the film and, subsequently, with a much higher speed for causing it to tear and placing the thus obtained sheet on the elevator. The length of the packaging sheets varies according to the format of the packages to be produced but the path that each sheet must follow in order to be positioned on the elevator of the packaging machine has always the same length. Therefore, to meet the production rate of the packaging machine, the shorter sheets are subjected to higher accelerations which subject the packaging film to excessive stress and can also cause loss of precision in positioning and orientating of the sheets on the elevator.

SUMMARY

The present invention relates, in particular, to the structure of the film feeding unit in packaging machines of the type described above aiming at increasing the positioning accuracy of the packaging sheets on the elevator. Furthermore, a feeding unit for feeding a plastic film in packaging machines according to the present invention can be configured to increase operative efficiency in the transfer and positioning phases of the sheets obtained from the packaging film.

This result has been achieved, in accordance with the present invention, by providing a device having the characteristics indicated in claim 1. Other features of the present invention are the subject of the dependent claims.

Thanks to the present invention, it is possible to increase the positioning accuracy of the sheets obtained from the packaging film on the elevator. Furthermore, it is possible to configure the feeding unit so as to subject the individual sheets obtained from the film to less stress with the further advantage of increasing the production without compromising the quality of the sheets and without compromising the positioning accuracy of the packaging sheets. Furthermore, an operating unit according to the present invention is relatively simple to manufacture in relation to the advantages offered.

BRIEF DESCRIPTION OF THE FIGURES

These and further advantages and characteristics of the present invention will be more and better understood by each person skilled in the art thanks to the description that follows and the annexed drawings, provided by way of example but not to be considered in a limiting sense, in which.

DETAILED DESCRIPTION OF THE EMBODIMENTS

Figure 1:
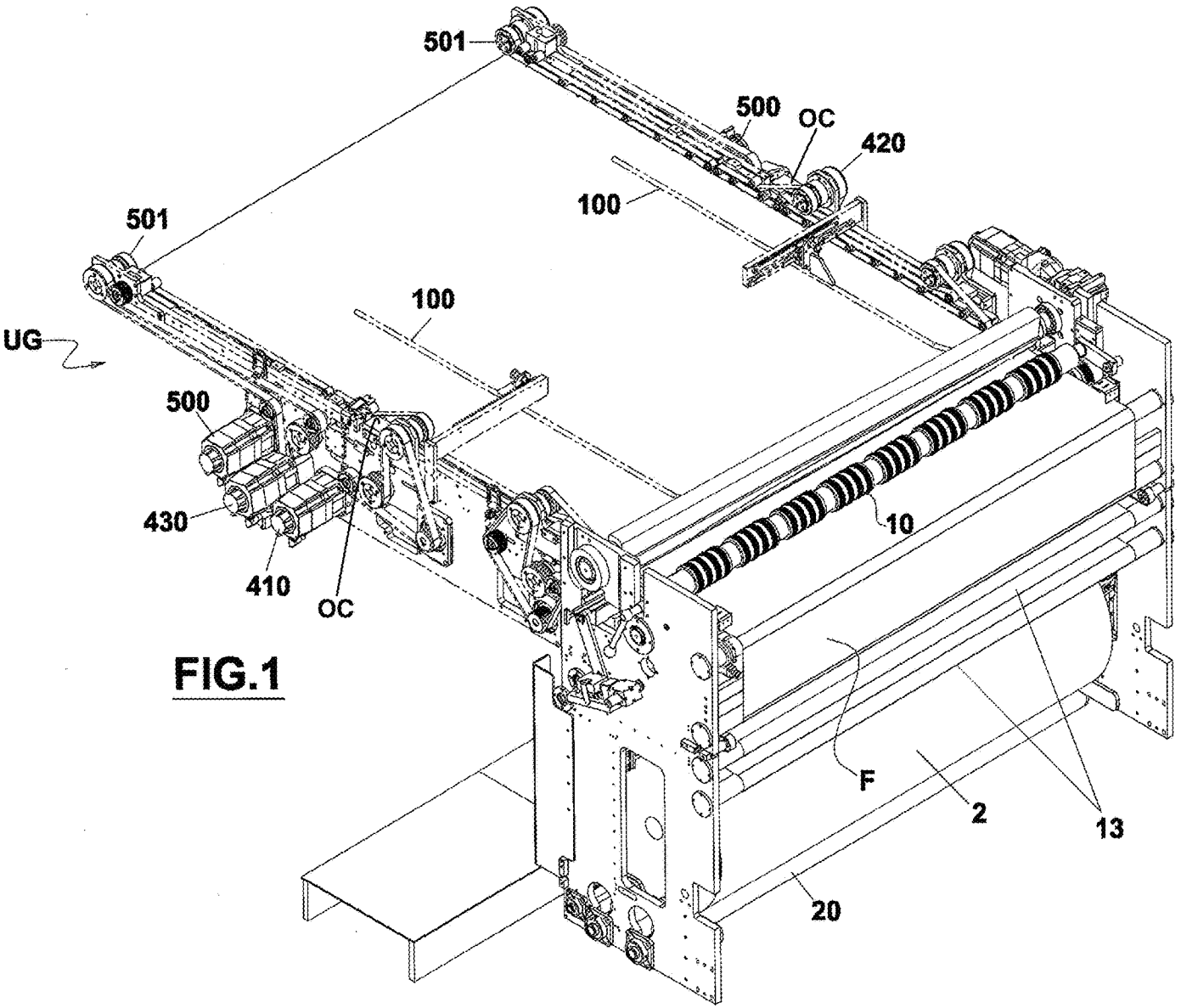
FIG. 1 is a schematic perspective view of a unit for feeding a plastic film in accordance with the present invention.

Reduced to its basic structure and with reference to the attached drawings, a feeding unit (UG) for feeding a plastic film in packaging machines configured, in particular, for packaging paper rolls, in accordance with the present invention comprises:

- a unit (1) for unwinding the plastic film (F) from a corresponding reel (2);
- a cutting device (3) arranged downstream of the unwinding unit (1) with respect to the direction followed by the film (F);
- a transfer device (4) arranged downstream of the cutting device (3);
- a positioning device (5) located downstream of the transfer device (4).

The unwinding unit (1) comprises a pair of horizontal unwinding rollers (10, 11) which define a nip (N) that is crossed by the film (F) and which are suitably motorized so as to exert, in cooperation with each other, a dragging action on the film which causes the unwinding of the film itself from the reel (2). According to a known procedure, the unwinding rollers (10, 11) are driven, by a programmable control unit, for a time related to the unwinding of an amount of film having a predetermined length. The reel (2) rests on a base comprising two horizontal axis support rollers (20) by which the reel is rotated around its own axis to allow the film (F) to unwind from the reel. The rollers (20) are arranged between two flanks (12) of the unwinding unit and are enslaved to a respective electric motor (200) that controls their rotation with a predetermined angular speed. The unwinding rollers (10, 11) are also arranged on the same flanks (12). The axes of the reel (2), of the unwinding rollers (10, 11) and of the support rollers (20) are parallel to each other and orthogonal to said flanks (12). The unwinding rollers (10, 11) are on the opposite side of the support rollers (20) with respect to the reel (2). The flanks (12) define the right and left sides of the unit (UG).

Guide rollers (13) are arranged between the unwinding rollers (10, 11) and the reel (2), parallel to the unwinding rollers (10, 11), by which the film (F) unwound from the reel (2) is guided up to the unwinding rollers. Between the reel (2) and the unwinding rollers (10, 11) one or more tensioning rollers or "dancers" (130) can also be arranged to adjust the tension of the film (F) according to methods known to those skilled in the art.

A photocell (FC), positioned upstream of the unwinding rollers (10, 11) both on the right and on the left side of the unit (UG), is provided for detecting the passage of the film (F) with known methods, by reading signs formed on the side edges of the same film.

The cutting device (3), that is known per se to those skilled in the art, serves to produce a discontinuous incision in the film (F) to create a tear-off line which allows to obtain sheets of predetermined length from the same film. In the example shown in the drawings, the cutting device (3) comprises a scoring roller (30) arranged downstream of the aforesaid nip (N) with respect to the direction followed by the film (F). The scoring roller (30) is parallel to the unwinding rollers (10, 11), is provided with a blade (32) configured to engrave the film (F) as previously said, is driven by a corresponding electric motor (33), and cooperates with an underlying fixed counter-blade (34) to produce the discontinuous incision on the film (F).

The transfer device (4), so called because it controls the transfer of the film from the unwinding unit (1) to the positioning device (5), comprises, both on the right and on the left side of the unit (UG), two opposite belts (40, 41), wound in a loop around corresponding pulleys and driving rollers, that always have a side facing the advancement direction (A) of the film (F) and are mutually arranged to engage both sides of the film so as to guide it between an entrance area (H), near the cutting device (3), and an exit area at a predetermined distance from the entrance area. With reference to the example shown in the drawings, the upper belts (40) are controlled by the motor electrical (410) that drives the pulley (401) through the transmission (400). The pulley (401) transmits the motion to the upper belts (40) which are held and guided by the rollers (402) aligned parallel to the aforementioned direction (A). The lower belts (41) are also driven by the electric motor (410) on which is mounted the pulley (411) that transmits the motion to the lower belts (41), which are held and guided by the rollers (412) also aligned parallel to the aforementioned direction (A). The lower belts (41) have an input side closer to the cutting device (3) than the upper belts (40) so as to form an input area (H) for the film (F) which, immediately downstream of the cutting device (3), is formed only by the lower belts (41) to facilitate the entry of the film (F) into the transfer device (4). The motor (410) and the rollers (402, 412) are integral with the flanks (12) of the unit (UG).

Figure 2:
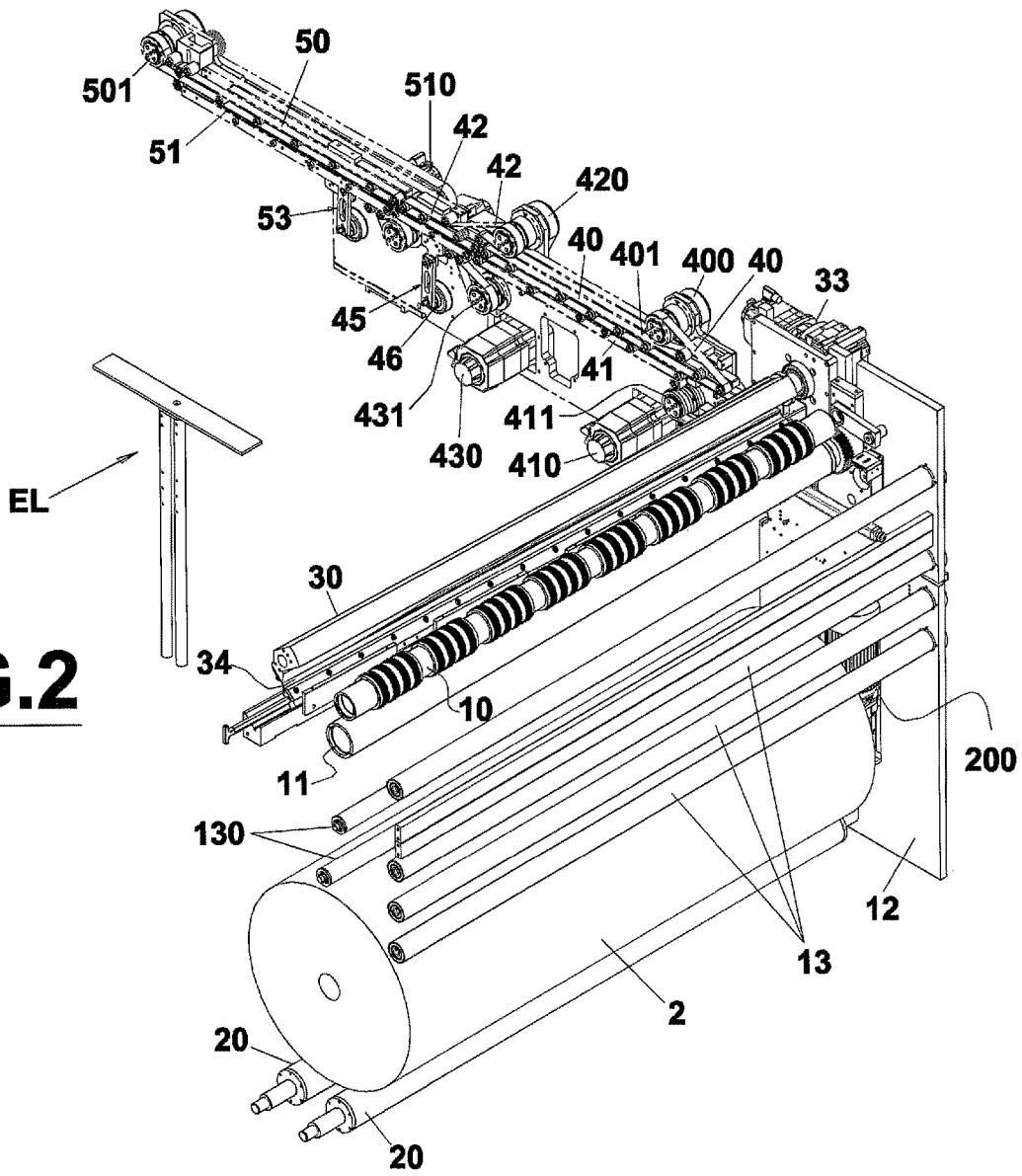
FIG. 2 represents the unit of FIG. 1 with parts removed to better show other parts of the unit.
Figure 3:
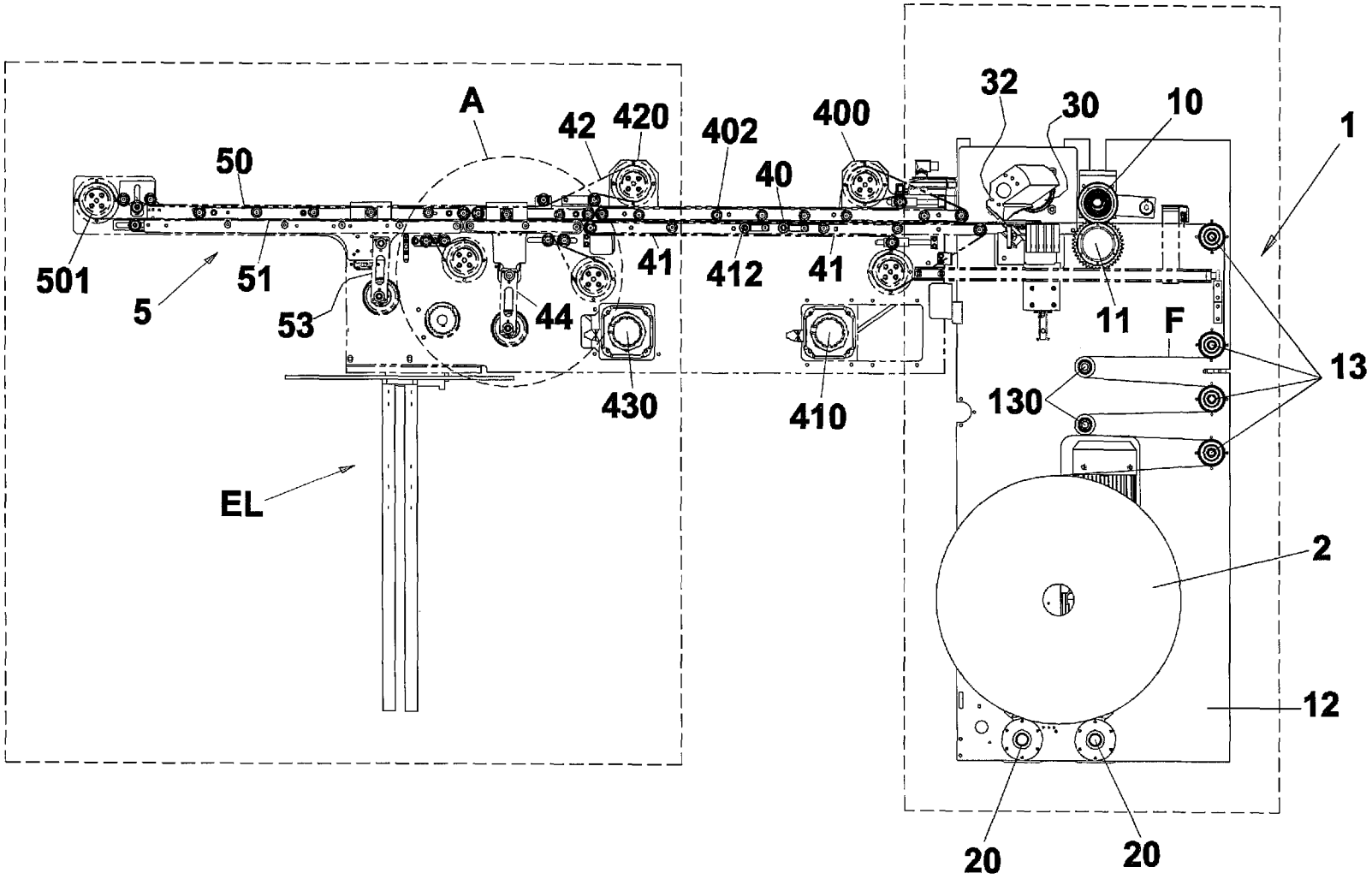
FIG. 3 is a side view of the assembly shown in FIG. 2.
Figure 4:
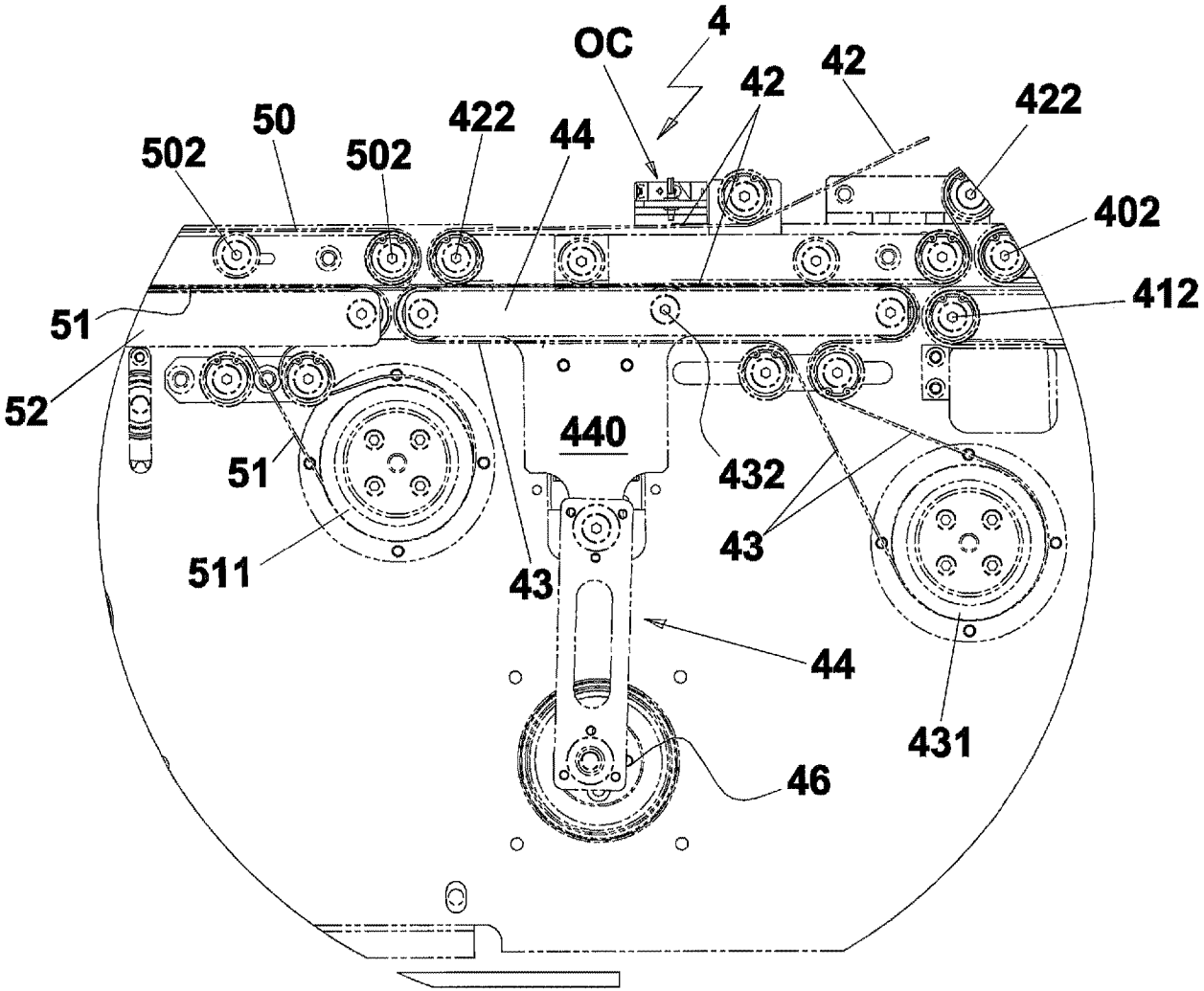
FIG. 4 is enlarged details of FIG. 3.
Figure 5:
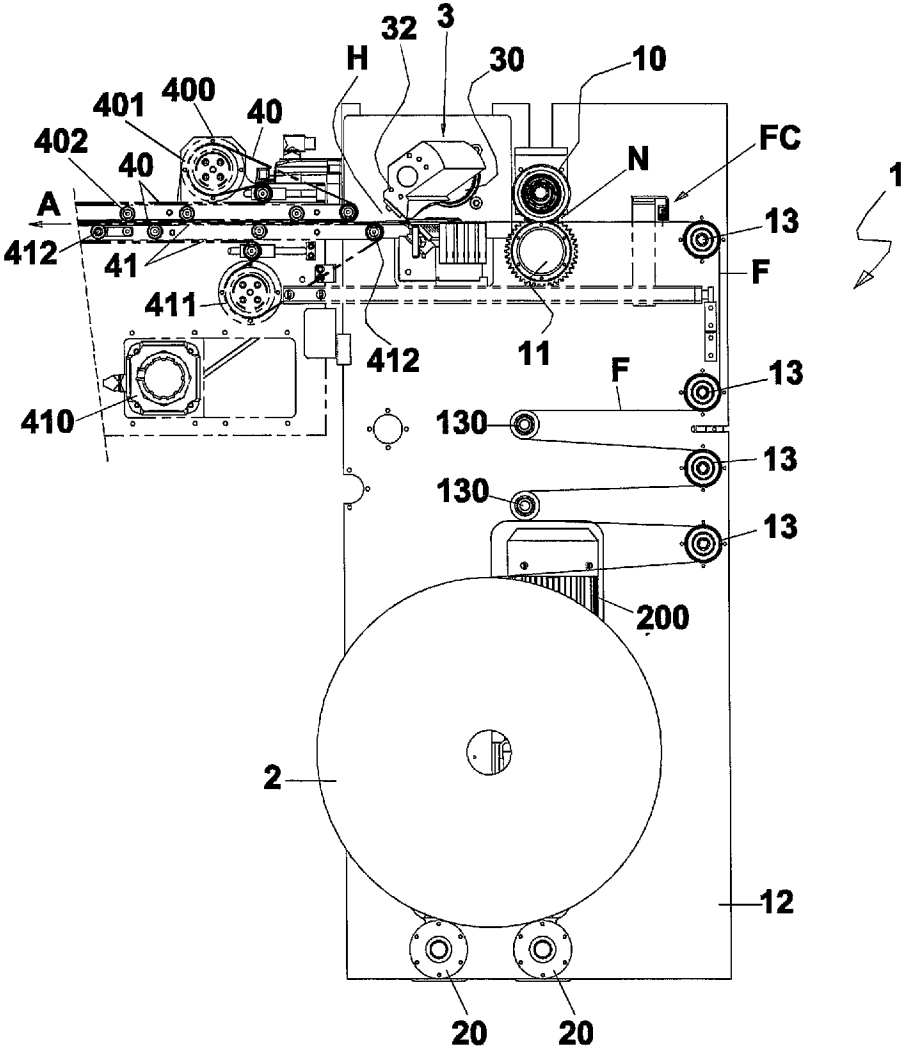
FIG. 5 is enlarged details of FIG. 3.
Figure 6:
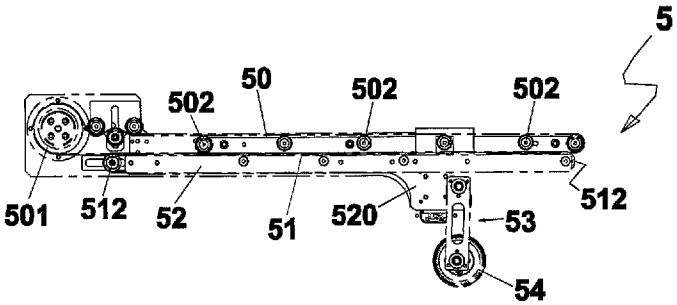
FIG. 6 is enlarged details of FIG. 3.
Figure 7:
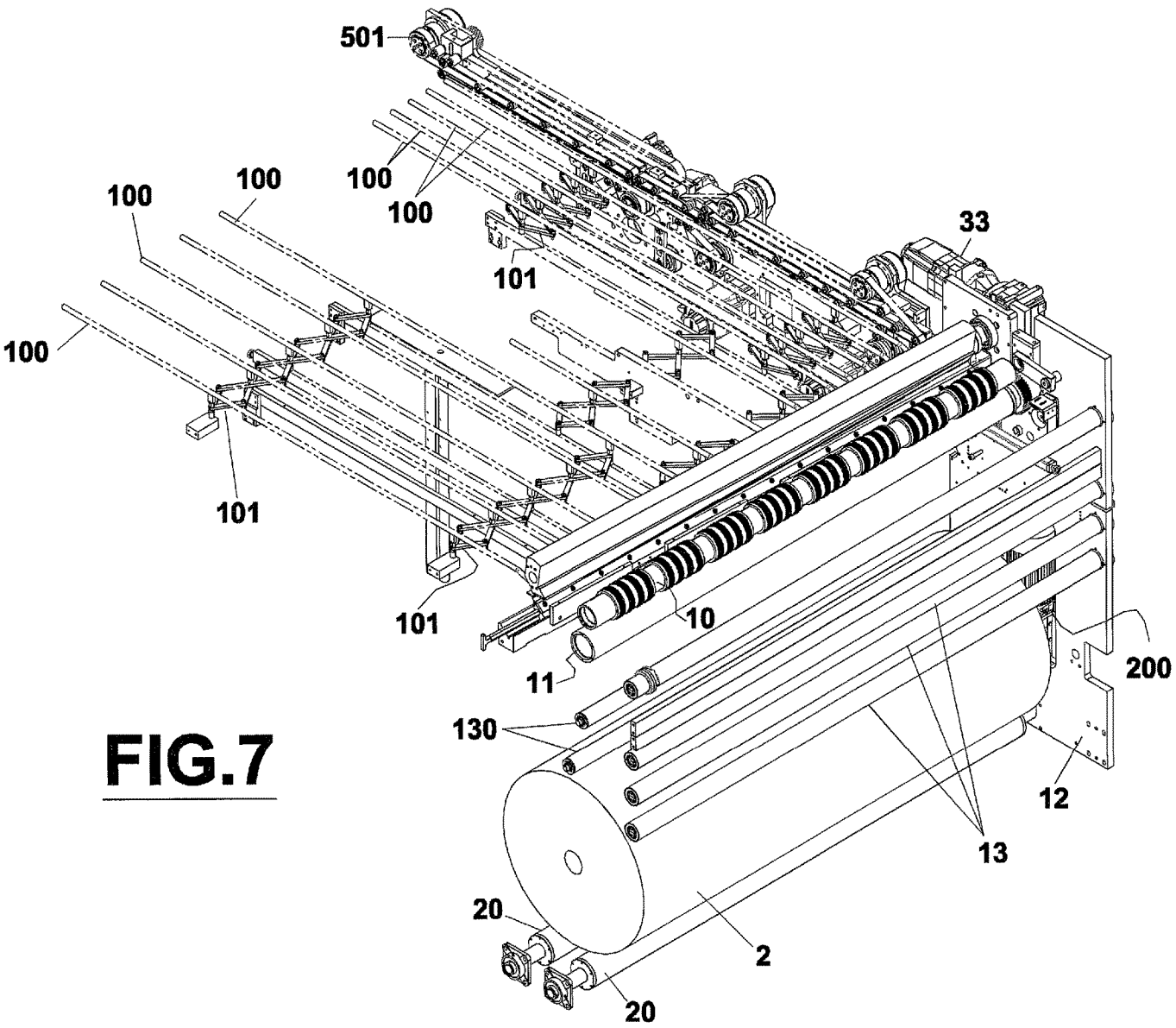
FIG. 7 is similar to FIG. 2 but it shows further elements of the unit.
Figure 8:
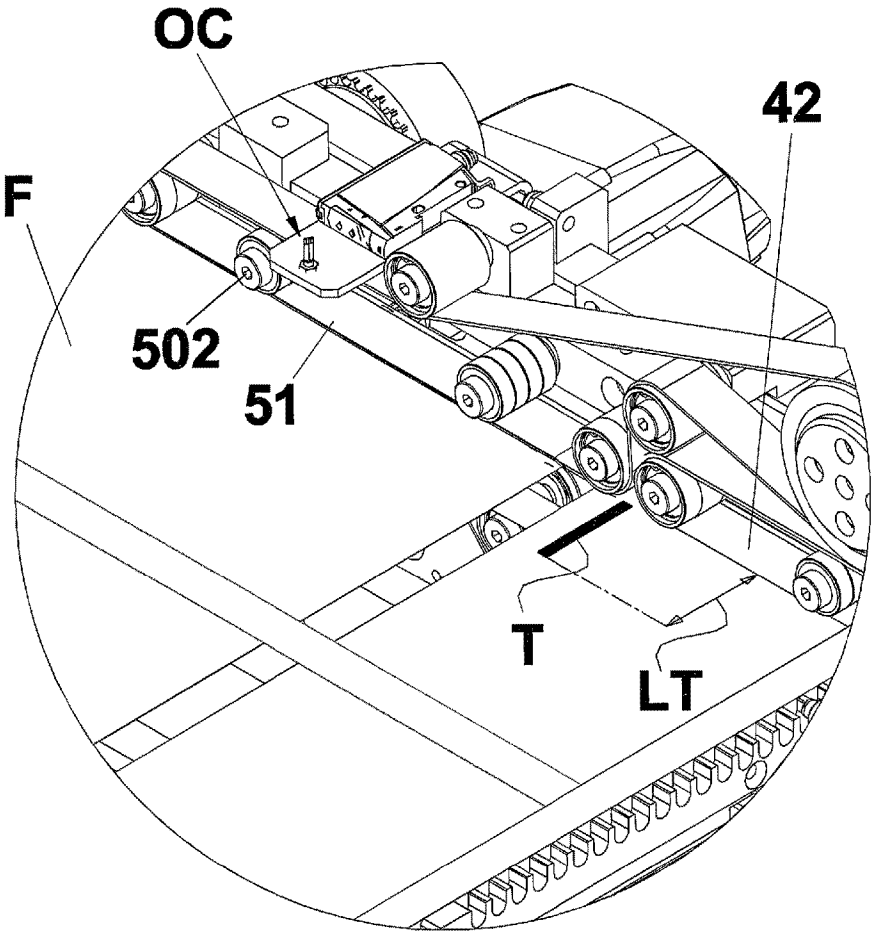
FIG. 8 is an enlarged detail of FIG. 2.

With reference to the example shown in the drawings, the transfer device (4) further comprises, on both the right and left side of the unit (UG), two additional opposite belts (42, 43) arranged downstream of the others (40, 41) with respect to the direction (A) followed by the film (F) in the unit (UG). The additional belts (42, 43) are also mutually arranged so that they can engage both sides of the film (F). With reference to the example shown in the drawings, the upper belts (42) are driven by the electric motor (430) to which the pulley (420) is connected, which transmits the motion to the upper belts (42) guided by the rollers (422) aligned along the direction (A). The lower belts (43) are also driven by the electric motor (430) on which the pulley (431) is mounted, which transmits motion to the lower belts (43) kept in guide by the rollers (432) also aligned according to direction (A). The motor (430) and the rollers (422) are integral with the flanks (12) of the units (UG). The rollers (432) which guide the lower belts (43) are mounted on a support (44) connected to a rod-crank mechanism (45) that, driven by a corresponding electric motor (46) partially visible in FIG. 2, cyclically determines the approach of the lower belts (43) to the upper belts (42) and, respectively, their mutual distancing as further described below. Said support (44) is constrained to the respective flank (12) of the group (UG). The support (44) is connected to the mechanism (45) by means of a corresponding lower appendix (440).

In practice, the device (4) is formed, on each side of the unit (UG), by two pairs of opposite belts (40, 41; 42, 43) arranged in cascade along the direction (A) followed by the film (F). In other words, the device (4) shown in the annexed drawings, is divided into two sections, the first one comprising the belts (40, 41), the second comprising the belts (42, 43), operated independently from each other by respective electric motors.

The positioning device (5), so called because it is intended to position the sheets obtained from the film (F) on the elevator (EL) normally arranged in the packaging machine, is arranged downstream of the transfer device (4) with respect to the direction (A) followed by the film in the unit (UG), and extends up to a station of the packaging machine intermediate between the forming line and the elevator on which the rolls are positioned to be packaged. In accordance with the example shown in the drawings, the positioning device (5) comprises, on both the right and left side of the unit (UG), two opposite belts (50, 51) which form two horizontal rings developed according to the direction of exit of the film. In accordance with the example shown in the drawings, the upper belts (50) are driven by the electric motor (500) on which the pulley (501) is mounted, which transmits the motion to the upper belts (50) guided by the rollers (502) aligned along the aforementioned direction (A). The lower belts (51) are also driven by the electric motor (500) on which the pulley (511) is mounted, which transmits motion to the lower belts (51) guided by the rollers (512) also aligned according to said direction (A). The motor (500) and the rollers (502) are integral with the flanks (12) of the unit (UG). The rollers (512) that guide the lower belts (51) are mounted on a support (52) connected to a rod-crank mechanism (53) that, operated by a corresponding electric motor (54), cyclically determines the approach of the lower belts (51) to the upper belts (50) and, respectively, their mutual distancing. Said support (52) is constrained to the respective flank (12) of the unit (UG). With respect to the direction (A) of advancement of the film (F), the support (52) has a rear side with a lower appendix (520) connected to the mechanism (53) and an opposite front side facing the zone (E) of exit of the film (F) from the unit (UG).

Therefore, the distance between the belts (50, 51) as well as the distance between the belts (42, 43) can be controlled. In particular, these distances can be changed cyclically during the operation of the machine, thanks to the mechanisms (45) and (53) which constitute means for obtaining a cyclic variation of these distances.

A possible way of operating the unit (UG) described above is the following.

For the treatment of shorter sheets (that is, for example, sheets between 240 mm and 500 mm in length), the length of which is determined in any case, as for the longest sheets, by the intervention of the transversal perforation means, the distance between the belts (42, 43) initially equals the distance between the belts (40, 41). In this phase, the belts (42, 43) have a first speed which is equal to the speed of the belts (40, 41) and this speed is maintained until the belts (42, 43) have engaged a section of predetermined length (for example, 80 mm) of the sheet. At this point, the mechanism (45) intervenes and causes a greater tightening of the belts (42, 43) on the film and the same belts (42, 43) undergo an acceleration until a second speed is reached and this causes the film to tear at the previously formed transverse perforation. In this way, the belts (42, 43), maintaining the second speed, lead the sheet to the belts (50, 51) which then determine the positioning of the sheet on the elevator (EL). Therefore, the belts (50, 51) are not obliged to follow the acceleration/deceleration ramps typical of traditional systems and the sheet is subjected to less stress without deteriorating, which implies the possibility of treating a greater number of sheets in a same time interval, with consequent increase in machine production.

When the sheets are longer (for example, sheets having a length between 500 and 1100 mm), the operation of the belts (50, 51) is identical to that of the traditional machines as regards the acceleration/deceleration ramps and the intermediate belts (42, 43) constitute a back extension of the belts (50, 51), in the sense that they are controlled like the belts (50, 51).

The phase of positioning the sheets obtained from the film (F) on the elevator (EL) takes place with methods known to those skilled in the art, as well as the subsequent phase of use of the sheet by the packaging machine.

In a manner known per se, the flanks of the unit (UG) can be spaced according to the width of the film used. Downstream of the cutting device, the unit (UG) has a plurality of rods (100) parallel to each other and oriented according to the direction (A) of advancement of the film (F), which are constrained to respective support pantographs (101) allowing variations of their mutual distance. In this way, a sliding plane for the film (F) is formed, the width of which can be adjusted according to the width of the film.

The motors that drive the belts (40, 41; 42, 43; 50, 51) on the right side of the unit (UG) are controlled independently with respect to the corresponding motors on the left side to allow compensation, according to methods known to those skilled in the art, of possible misalignments of the film (F) with respect to the predetermined direction (A) of advancement of the film.

Advantageously, in accordance with the present invention, both on the right and on the left side of the group (UG), or on only one side of the group (UG), optical detection means are arranged to detect the passage of a sign (T) formed on the film (F). Said optical means are positioned in correspondence with the belts (50, 51) of the positioning device (5), or at a predetermined distance from the input section of the latter.

For example, said signs (T) consist of straight segments oriented transversely to the film, formed at a predetermined distance from each other along the longitudinal direction of development of the same film. The individual sheets (SF) obtained from the film (F) therefore have said signs (T) at a predetermined distance from the respective leading edge (HF). For example, the signs (T) are printed on the film (F).

Figure 10:
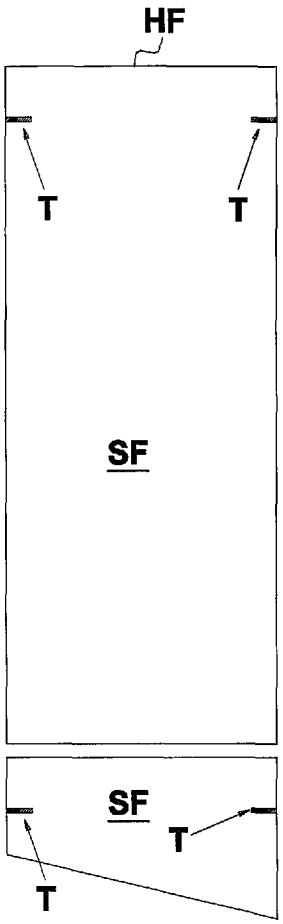
FIG. 10 schematically represents the signs on a sheet of a packaging film according to a possible configurations.
Figure 9:
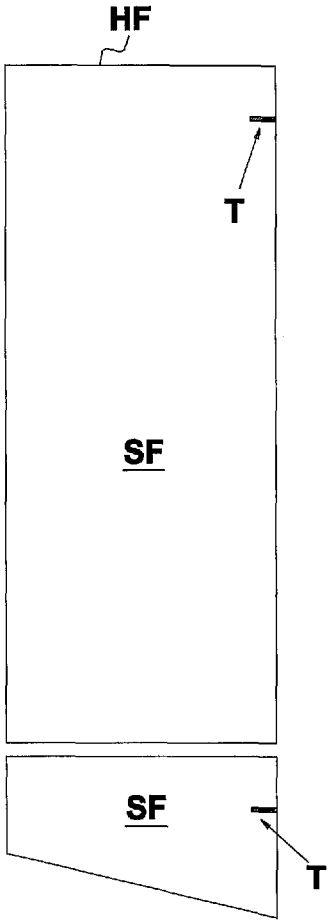
FIG. 9 schematically represents the signs on a sheet of a packaging film according to a possible configurations.

With reference to the example shown in the attached drawings, each segment (T) has a predetermined length (LT) starting from a corresponding longitudinal edge of the film (F). Said signs (T) can be formed on one side of the film (F) or on both the left and right on the elevator of the film. In the diagram of FIG. 9 the signs (T) are on one side of the film (F), while in the diagram of FIG. 10 they are formed both on the right and on the left side of the film. If the aforementioned optical means for detecting the passage of the signs (T) are arranged on both the left and right sides of the group (UG), it is possible to control the passage of the signs (T) both in the event that these signs are formed only on one side of the film, and if the signs (T) are formed on both sides of the latter.

For example, said optical means consist of photocells (OC) whose optical axis is oriented towards the path followed by the film (F) in the positioning device. The time which, under conditions of correct operation of group (OG), elapses during the passage of the signs (T) of the same right or left side of two consecutive sheets (SF) in correspondence with a photocell (OC) is the "cycle time". Once a specific production has been programmed, the cycle time is a known value.

Figure 11:
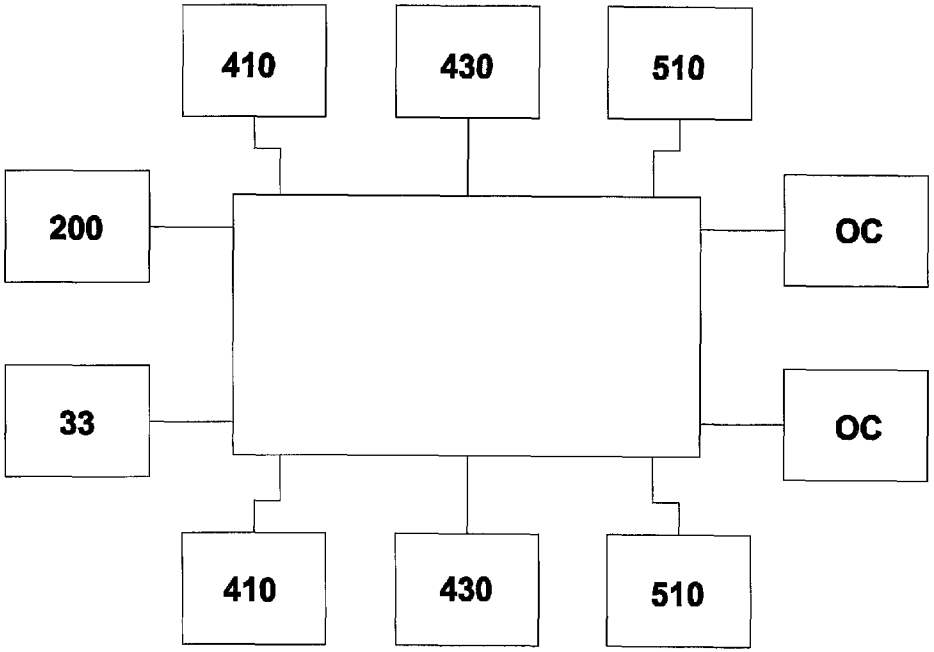
FIG. 11 is a simplified block diagram relating to a possible configuration of a control system for controlling actuators and sensing devices in a feeding unit according to the present invention.

Said photocells (OC) are connected to a programmable control unit (UE) that, in particular, controls the drive motors of the belts of the transfer and positioning devices. The simplified block diagram of FIG. 11 shows a possible configuration of the connections between the unit (UE) and the devices connected to it. The control unit (UE) acts on the aforementioned motors, as further described below, according to the detections of the photocells (OC). If the time that elapses during the passage of the signs (T) of the same right or left side of two consecutive sheets (SF) is greater than the cycle time, the unit (UE) commands an increase in the speed of movement of the sheets (SF) in the group (UG) up to bringing the error to a value lower than a predetermined limit. Conversely, if the time that elapses during the passage of the signs (T) of the same right or left side of two consecutive sheets (SF) is less than the cycle time, the unit (UE) commands a decrease in the speed of movement of the sheets (SF) in the group (UG) to bring the error to a value lower than a predetermined limit. For example, for a 500 mm long sheet fed and a sheet feeding speed equal to 200 sheets/minute (corresponding to the production of 200 packs per minute), the programmed cycle time is equal to 0.3 sec.

The control unit (UE) is programmed to intervene on the motors (510) that operate the belts of the positioning device (5) so as to modify its speed if the photocells (OC) detect the anticipated or delayed passage of the signs (T) with respect to the correct sequence on the basis of the programmed production. More specifically, if the photocells (OC) detect the anticipated passage of the signs (T), i.e. if the time interval between the passage of the signs (T) on the same side of two consecutive sheets (SF) is less than the cycle time, the control unit (UE) controls the slowing down of the belts (50, 51) by intervening on the relative motor (510). Conversely, if the photocells (OC) detect the delayed passage of the signs (T), i.e. if the time interval between the passage of the signs (T) on the same side of two consecutive sheets (SF) is greater than the cycle time, the control unit (UE) commands an increase in the speed of the belts (50, 51) also intervening on the relative motor (510). The correction performed by the control unit (UE) is interrupted when the detected error is canceled or when this error is less than a predetermined limit value.

As previously mentioned, the film (F) can have the signs (T) on one side only or on both sides. In the first case, the control previously described is carried out on only one side of the film and has the effect of determining a more correct positioning of the individual sheets on the elevator (EL). In the second case, the aforementioned check is carried out on both the right and left sides of the sheets and, since the motors (510) which operate the belts (50, 51) on the right and left sides of the group (UG) are independent from each other, the correction indicated above can be performed independently on the right and left side of the sheets. Consequently, it is possible to position the individual sheets on the elevator (EL) such that the edges of the sheets are always parallel to the homologous edges of the elevator (EL).

In practice, possible positioning errors of the sheets (SF) are prevented, errors due, for example, to the wear of the belts that drag the sheets inside the unit (UG) or, for example, due to loss of efficiency of the connections between said belts and the members to which they are enslaved, or to geometric deformations of these members due to the loads acting on them.

Any continuity over time of the position errors detected as described above can be interpreted as an indication of malfunction of the film feeding group. Therefore, the described device also constitutes a control system for the regular operation of the group.

Although in the embodiment described above the transfer device (4) consists of two pairs of opposing belts (40, 41; 42, 43) for each side of the unit, it is understood that the sign control mechanism (T) can also be mounted in a feeding group in which the transfer device (4) consists of only two opposing belts on each of the right and left sides of the group as in the film feeding units mostly present on the market.

From the foregoing description, it is evident that, in accordance with the present invention, a feeding unit (UG) for feeding a plastic film in packaging machines intended, in particular, for wrapping paper rolls, comprises:

- a unit (1) for unwinding the film (F) from a corresponding reel (2);
- a cutting device (3) arranged downstream of the unwinding unit (1) with respect to the direction followed by the film (F) and configured for transversely incising the film to allow to obtain sheets (SF) having a predetermined length;
- a transfer device (4) arranged downstream of the cutting device (3) and comprising, both on the right and on the left side of the feeding unit, a predetermined number of drive belts configured for engaging both the upper and lower faces of the film; and
- a positioning device (5) located downstream of the transfer device (4) and comprising, both on the right and on the left side, a predetermined number of drive belts (50, 51) adapted to engaging both the upper and lower faces of the film; wherein
- the belts (50, 51) of the positioning device (5) are controlled by a control unit (UE) to which are connected optical means (OC) adapted to detect the passage of a series of signs (T) formed on the film (F), i.e. on each sheet (SF) obtained from the same film, said control unit (UE) being programmed to compare a transit time that elapses during the passage of the signs (T) of the same right or left side of two consecutive sheets (SF) with a reference cycle time and to increase or decrease the speed of said belts (50, 51) if the transit time is less or greater than the reference cycle time.

In practice, the details of execution may in any case vary in an equivalent manner as regards the individual elements described and illustrated, without thereby departing from the scope of the solution idea adopted and therefore remaining within the limits of the protection offered by this patent in accordance with the appended claims.

The invention claimed is:

1. A feeding unit for feeding a film of plastic material in packaging machines for packaging paper rolls, the feeding unit having a right side and a left side and comprising:

- a unit for unwinding the film from a corresponding reel;
- a cutting device arranged downstream of the unwinding unit with respect to a feeding direction of the film and adapted to incise the film transversely to obtain sheets of predetermined length from the film;
- a transfer device arranged downstream of the cutting device and comprising, on each of the right side of the feeding unit and on the left side of the feeding unit, transfer drive belts able to engage both the upper face of the film and the lower face of the film; and
- a positioning device located downstream of the transfer device and comprising, on each of the right side of the feeding unit and the left side of the feeding unit, positioning drive belts able to engage both the upper face of the film and the lower face of the film;

wherein the positioning drive belts of the positioning device are controlled by a programmable control unit to which are connected optical means able to detect the transit of a series of signs formed on the film, said control unit being programmed to compare a transit time that elapses during the passage of the signs of the same right or left side of two consecutive sheets with a reference cycle time and to increase or decrease the speed of said positioning drive belts of the positioning device after cutting of the film into sheets and independently of the transfer drive belts arranged upstream of the positioning device, if the transit time is less than or greater than the reference cycle time.

2. The feeding unit according to claim 1, wherein:

the transfer drive belts of the transfer device further comprise, on each of the right side of the feeding unit and the left side of the feeding unit, a first pair of transfer drive belts and a second pair of transfer drive belts, in opposite relationship with respect to the path followed by the film, with the first pair of transfer drive belts arranged immediately downstream of the cutting device and the second pair of transfer drive belts provided immediately downstream of the first pair of transfer drive belts;

the positioning drive belts of the positioning device comprise, on each of the right side of the feeding unit and the left side of the feeding unit, a pair of positioning drive belts in opposite relationship with respect to the path followed by the film, said positioning drive belts of the positioning device being arranged immediately downstream of said second pair of transfer drive belts of the transfer device; and both on the right side of the feeding unit and on the left side of the feeding unit, the first pair of transfer drive belts, the second pair of transfer drive belts, and the pair of positioning drive belts are operated by independent actuators.

3. The feeding unit according to claim 2, wherein said actuators are electric motors.

4. The feeding unit according to claim 2, wherein the distance between the belts of said second pair of transfer belts varies cyclically between a minimum value and a maximum value.

5. The feeding unit according to claim 1, wherein said optical means comprise a photocell arranged only on the right side of the feeding unit or only on the left side of the feeding unit, or two photocells on both the right side of the feeding unit and the left side of the feeding unit in correspondence of the positioning device.

6. The feeding unit according to claim 1, wherein the unwinding unit comprises a pair of horizontal unwinding rollers that define a nip traversable by the film and are motorized so as to exert, in cooperation with each other, a dragging action on the film which determines the unwinding of the film from the reel.

7. The feeding unit according to claim 1, further comprising a support base for the reel with two horizontal axis support rollers through which the reel is rotated about its own axis to allow the unwinding of the film from the reel, said rollers being connected to a respective electric motor which controls their rotation with a predetermined angular speed.

8. The feeding unit according to claim 1, wherein the distance between the positioning belts of the positioning device varies cyclically between a minimum value and a maximum value.

9. The feeding unit according to claim 1, wherein the feeding unit feeds sheets, obtained from said film, having a length comprised between 240 mm and 1100 mm.

10. The feeding unit according to claim 1, in which the right side of the feeding unit and the left side of the feeding unit are parallel to a feeding direction of the film, wherein the distance between the right side of the feeding unit and the left side of the feeding unit is adjustable according to the width of the film.

* * * * *